US007505601B1

(12) United States Patent
Brungart

(10) Patent No.: US 7,505,601 B1
(45) Date of Patent: Mar. 17, 2009

(54) EFFICIENT SPATIAL SEPARATION OF SPEECH SIGNALS

(75) Inventor: Douglas S. Brungart, Bellbrook, OH (US)

(73) Assignee: United States of America as represented by the Secretary of the Air Force, Washington, DC (US)

( * ) Notice: Subject to any disclaimer, the term of this patent is extended or adjusted under 35 U.S.C. 154(b) by 978 days.

(21) Appl. No.: 11/054,225

(22) Filed: Feb. 9, 2005

(51) Int. Cl.
*H04R 5/02* (2006.01)
*H04R 5/00* (2006.01)

(52) U.S. Cl. ..... 381/309; 381/17; 381/123

(58) Field of Classification Search ..... 381/1, 381/17–19, 61, 300, 309, 310, 26, 74, 123
See application file for complete search history.

(56) References Cited

U.S. PATENT DOCUMENTS 5,173,944 A * 12/1992 Begault ..... 381/17
5,371,799 A * 12/1994 Lowe et al. ..... 381/310
5,404,406 A * 4/1995 Fuchigami et al. ..... 381/17
5,452,359 A * 9/1995 Inanaga et al. ..... 381/310
6,011,851 A 1/2000 Conner et al.
6,021,206 A 2/2000 McGrath
6,243,476 B1 * 6/2001 Gardner ..... 381/303
6,442,277 B1 * 8/2002 Lueck et al. ..... 381/17
6,731,759 B2 * 5/2004 Terai et al. ..... 381/17
7,095,865 B2 * 8/2006 Katayama et al. ..... 381/309
7,333,622 B2 * 2/2008 Algazi et al. ..... 381/310
7,391,877 B1 * 6/2008 Brungart ..... 381/310
7,415,123 B2 * 8/2008 Ballas ..... 381/309

* cited by examiner

*Primary Examiner*—Xu Mei
(74) *Attorney, Agent, or Firm*—AFMCLO/JAZ; Gina S. Tollefson

(57) ABSTRACT

A computationally efficient method and device for adding spatial audio capabilities to new and existing centrally switched communication systems without modifying the internal operation of the systems or the switching architecture by producing a digitally filtered copy of each input signal to represent a contralateral-ear signal with each desired talker location and treating each of a listener's ears as separate end users.

20 Claims, 7 Drawing Sheets

EFFICIENT SPATIAL SEPARATION OF SPEECH SIGNALS

RIGHTS OF THE GOVERNMENT

The invention described herein may be manufactured and used by or for the Government of the United States for all governmental purposes without the payment of any royalty.

BACKGROUND OF THE INVENTION

The invention relates to communication systems and more particularly to multitalker communication systems using spatial processing.

In communications tasks that involve more than one simultaneous talker, substantial benefits in overall listening intelligibility can be obtained by digitally processing the individual speech signals to make them appear to originate from talkers at different spatial locations relative to the listener. In all cases, these intelligibility benefits require a binaural communication system that is capable of independently manipulating the audio signals presented to the listener's left and right ears. In situations that involve three or fewer speech channels, most of the benefits of spatial separation can be achieved simply by presenting the talkers in the left ear alone, the right ear alone, or in both ears simultaneously. However, many complex tasks, including air traffic control, military command and control, electronic surveillance, and emergency service dispatching require listeners to monitor more than three simultaneous systems. Systems designed to address the needs of these challenging applications require the spatial separation of more than three simultaneous speech signals and thus necessitate more sophisticated signal-processing techniques that reproduce the binaural cues that normally occur when competing talkers are spatially separated in the real world. This can be achieved through the use of linear digital filters that replicate the linear transformations that occur when audio signals propagate from a distant sound source to the listener's left or right ears. These transformations are generally referred to as head-related transfer functions, or HRTFs. If a sound source is processed with digital filters that match the head related transfer function of the left and right ears and then presented to the listener through stereo headphones, it will appear to originate from the location relative to the listener's head where the head-related transfer function was measured. Prior research has shown that speech intelligibility in multi-channel speech displays is substantially improved when the different competing talkers are processed with head-related transfer function filters for different locations before they are presented to the listener.

In practice, the methods used to implement spatial processing in a multichannel communication system depend on the architecture used in that system. The basic objective of a multichannel communications system is to allow each of N users to choose to listen to any combination of M input communications channels over a designated audio display device (usually a headset). In practice this can be achieved with either of two architectures: a distributed switching architecture or a central switching architecture. FIG. 1 shows an example of a prior art multialker communication system that uses a distributed system architecture. In the FIG. 1 architecture, every high-bandwidth input communications channel (A, B, C and D in this case represented at 100) is connected to a set of N remote switching systems, illustrated at 101, 105 and 106 that are physically located at or near each of the N users of the system. Each user is able to use a control panel, one of which is illustrated at 102 for the remote switching system 101, to select the individual gain levels of each of the M input channels (denoted by $g_i$ in the figure and one set which is illustrated at 103), and the input signals are scaled by these gain levels and summed together at 104 before being output to the user's headset.

FIG. 2 shows an example of a prior art multitalker communication system that uses a central switching architecture. In this architecture, the user control panels, illustrated at 200, are remotely connected to the central switching unit 201 with a low bandwidth control signal that allows the user, illustrated at 205, 206 and 207, to select the gains of each output channel, one of which is illustrated at 202. These gains are used to scale and combine the desired speech signals at the location of the central switching unit 201. Then a single high-bandwidth audio signal, one of which is shown at 203 and which occurs for each user, is sent to the remote location of the user and played over headphones 204.

TABLE 1

Comparison of Central and Distributed Switching

| | Distributed Switching | Central Switching |
|---|---|---|
| Central Processing | None | M * N Multiply and Accumulates |
| Remote Processing | M Multiply and Accumulates (per Station) | None |
| Central-Remote Connections | M High-Bandwidth Audio Channels | 1 High-Bandwidth Audio Channel |
| Remote-Central Connections | None | Adjustable gain for each channel |

Table 1 compares the advantages and disadvantages of distributed and central switching architecture. In general, a distributed switching architecture like that illustrated in FIG. 1 offers the most flexibility, because it allows each user station to be tailored to the specific needs of that user without changing the architecture of the remainder of the communication system. However, it has two major disadvantages: 1) it requires a large number of high-bandwidth audio signals to be transmitted to the location of each user; and 2) it requires processing power at the location of each user. In contrast, to the distributed switching system, the main advantage of the central switching system like that illustrated in FIG. 2 is that it requires only a single high-bandwidth audio signal to be transmitted from the central switch to each user location. It also concentrates all of the system processing demands into a central unit.

Historically, the costs of physically wiring connections between the locations of remote users and the costs of providing custom switching hardware at the location of each user have made distributed switching systems prohibitively expensive for all systems with more than a handful of possible input communications lines. In the future, however, network protocols such as voice-over art that allow multiple voice channels to be transmitted via a single connection point, combined with inexpensive and widely available DSP processing technology, are likely to make distributed switching the preferred architecture for all but the largest-capacity communications systems. Nevertheless, there is good reason to believe that centrally-switched systems will continue to be used for many years to come, both because they are the only systems capable of handling switching tasks with thousands or millions of users (such as the telephone system) and because many large and expensive systems using central switching architectures are currently in use in applications where they would be difficult or expensive to replace. Also, in some systems there are security issues that make it difficult to directly connect all possible communications channels to every user of the system.

FIG. 3 and FIG. 4 show how spatial separation would be added to systems with distributed or central switching architectures under the prior art as illustrated in FIGS. 1 and 2, respectively. Following along with the description in FIG. 1, FIG. 3 shows spatialized audio implementation with distributed switching. Similarly, following along with the description in FIG. 2, FIG. 4 shows spatialized audio implementation with central switching. This spatial separation in both FIGS. 3 and 4 is achieved by convolving each input speech channel with two separated finite-impulse-response (FIR) filters, $h_L(t)_\theta$ and $h_R(t)_\theta$. In FIG. 3 the filters are illustrated at 300 and in FIG. 4 the filters are illustrated at 400. The filters will reproduce the amplitude and phases associated with the signals reaching the listener's left and right ears from a sound source at location θ in the horizontal plane. At an 8 kHz sampling rate, these filters would be on the order of 16-32 points long and would therefore require roughly 256K multiply and accumulate operations per second. In addition to controlling the gain $g_i$ associated with each input channel, shown collectively at 301 in FIG. 3 and 401 in FIG. 4, the user has the additional option of selecting the location $\theta_i$ of each speech channel. This selection determines which set of head-related transfer function filters will be used to process each speech channel prior to being output to the listener. Also, note that the spatially separated system now needs to do a separate summation for each ear. In FIG. 3 left ear summation is illustrated at 302 and right ear summation is illustrated at 303. In FIG. 4 left ear summation is illustrated at 402 and right ear summation is illustrated at 403. The output is a stereo rather than mono output signal to the user's headset.

While the distributed switching system required for the spatialized communication system shown in FIG. 3 is considerably more complex than the distributed switching system associated with the non-spatial system shown in FIG. 1, it has the advantage of modularity: any one user station could be upgraded to three-dimensional audio without influencing any other aspects of the overall communications system. This is in direct contrast with the centrally switched three-dimensional audio system shown in FIG. 4.

The central-switching implementation of FIG. 4 requires the following extensive changes to the central switch: (i) the communications link from the user's control panel 404 to the central switch 405 must be changed to allow the user to select which head related transfer function filter set to use to process each communications channel; and (ii) the central switch 405 must now execute two variable FIR filters for the left and right output channels of each communication signal for each listener (i.e., M×N FIR filters); and a second full-bandwidth audio signal must be sent from the central switch 405 to the location of the remote user.

While these modifications are certainly possible to implement, considerable cost savings could be achieved if some way could be found to spatially separate speech signals in a centrally switched communication system without modifying the central switching architecture in any way. In addition to providing a method and device for adding spatial audio capabilities to an existing centrally switched communication system without modifying the internal operation of the system, the present invention provides a method and device which increases the computational efficiency of spatial processing for all centrally switched systems with more than a few simultaneous end users.

SUMMARY OF THE INVENTION

The present invention provides a computationally efficient method and device for adding spatial audio capabilities to an existing centrally switched communication system without modifying the internal operation of the system or the switching architecture by producing a digitally filtered copy of each input signal to represent a contralateral-ear signal with each desired talker location and treating each of a listener's ears as separate end users.

It is therefore an object of the invention to provide a computationally-efficient method and device for adding spatial audio capabilities to centrally switched communications systems.

It is another object of the invention to provide a method and device for adding spatial audio capabilities to an existing centrally switched communication system.

It is another object of the invention to provide a method and device for adding spatial audio capabilities to an existing centrally switched communication system without modifying the central switching architecture in any way.

It is another object of the invention to provide a method and device for adding spatial audio capabilities to an existing centrally switched communication system where any number of user stations can be upgraded to implement the 3D audio capability without interfering with the operation of any other aspects of the system.

It is another object of the invention to provide a method and device for adding spatial audio capabilities to an existing centrally switched communication system by producing a digitally filtered copy of each input signal to represent a contralateral-ear signal with each desired talker location and treating each of a listener's ears as separate end users.

These and other objects of the invention are described in the description, claims and accompanying drawings and are achieved by a device for replicating spatial location of audio signals propagated from a distant sound source to a listener's left and right ears within a centrally-switched multi-talker communication system comprising:

a plurality of input signals;

means for splitting each of said input signals into a plurality of duplicate signals;

a plurality of digital filters replicating a ratio of head-related transfer functions of the contralateral and ipsilateral ears for a particular spatial source location in a horizontal plane;

a central switching system for receiving output of said plurality of digital filters and processing as a plurality of different channels;

a left ear user control panel at the location of the user;

a right ear user control panel at the location of the user;

said right and left ear user control panels allowing selectibility from particular audio locations determined optimal for the presentation of speech in particular multitalker listening scenarios; and an audio display device for delivering output of said right and left ear user control panels to an operator whereby a user may appropriately select component audio signals presented to each ear and thereby place each input audio signal at a selected location.

DETAILED DESCRIPTION

The underlying basis of the invention is the observation that all of the capabilities associated with a spatial audio system can be achieved with a conventional centrally-switched communications system by a) taking advantage of the approximate left-right symmetry of the head-related transfer function in the spectral region associated with the bandwidth of human speech; b) creating multiple digitally filtered copies of each input signal to represent the contralateral-ear signal associated with each desired talker location in the system; and c) treating each of the listener's ears as a separate end user of the switching system.

Figure 5:
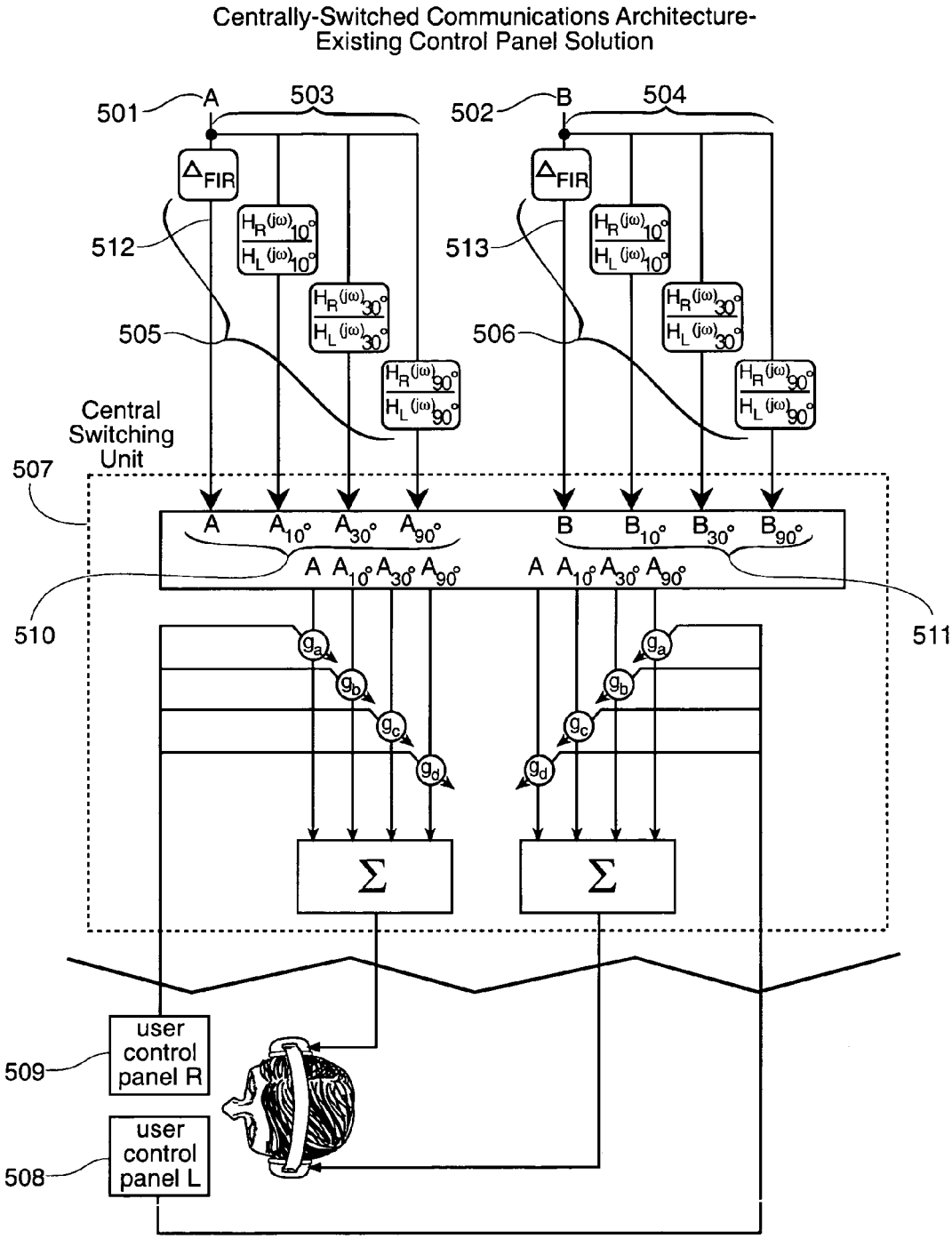
FIG. 5 is an implementation of a system with no changes to existing architecture according to the invention.

FIG. 5 shows an implementation of this system that allows each listener to select up to nine possible spatial locations for each input channel of the system. In this preferred arrangement of the invention, each input signal (A or B, shown at 501 and 502, respectively) is split into four signals, each a duplicate of the original, such signals illustrated at 503 for input signal A and 504 for input signal B, prior to being either digitally filtered with three filters. The three filters for input signal A are illustrated at 505 and the three filters for digital signal B are illustrated at 506. The three digital filters for each input signal capture the interauaral intensity and phase differences (i.e. the ratio of the frequency domain representations of the head-related transfer functions of the contralateral and ipsilateral ears) for sound sources located at 3 lateral positions in space (10, 30, and 90 degrees) or delayed by $\theta_{FIR}$, which represents an offsetting delay that compensates for the delays associated with the FIR filters used to process the other three input channels of the system (typically half the length of a linear phase digital FIR filter). These filters can be designed using traditional linear filter design procedures from the ratios of the frequency domain responses of the head-related transfer functions shown in FIG. 5.

The four processed channels are input into the central switching system 507 of FIG. 5 as four different input channels illustrated at 510 for input signal A and 511 for input signal B, named with either the same name as the original input (for the delayed but unfiltered signal) or with a subscript representing the lateral angle of the associated head-related transfer function filters. Therefore, each signal entering the central switching unit is a copy of the original input signal filtered through a head-related transfer function representing a desired talker location.

At the location of the user, the only difference from the original centrally switched communication system is that a second complete user station (control panel+output channel) is now assigned to provide the audio signal for the listener's second ear. The control panel for the right ear is shown at 509 and the control panel for the left ear is shown at 508.

Figure 6:
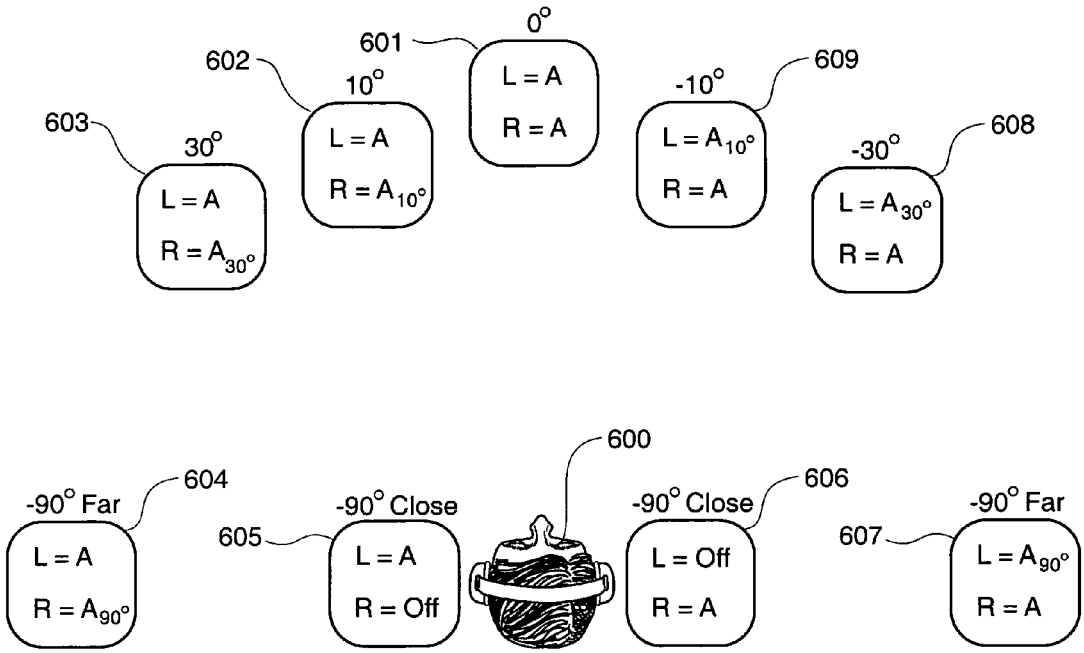
FIG. 6 illustrates a manual selection of left and right output signals for each of nine possible locations for each output channel of spatialized centrally switched communication system shown in FIG. 5 according to the invention.

FIG. 6 shows manual selections of left and right output signals for each of nine possible locations for each output channel of the spatialized centrally switched communication system shown in FIG. 5. The user or listener is shown at 600 in FIG. 6. The nine particular locations shown in FIG. 6 are 0 at 601, +−10 at 602 and 609, +−30 at 603 and 608, +−90 far at 604 and 607, and +−90 close at 605 and 606. By appropriately selecting the component audio signals presented to each ear as shown in FIG. 6, the user can choose to place each input audio signal at any of the nine possible apparent locations. Note that the assumption of left-right symmetry in the head-related transfer function has been used to reduce the number of required digitally processed input channels by a factor of two. Also note that the nine particular locations shown in FIG. 6 at 601-609 correspond to a set of locations that have been found to be near optimal for the presentation of speech in multitalker listening scenarios. However, any set of locations could be made available by this method. Also note that the +90 degree close at 605, −90 degree close at 606, and 0 degree at 601 conditions are generated by placing the unfiltered speech signal, shown at 512 and 513 in FIG. 5 in either the left ear only, the right ear only, or in both ears simultaneously. Thus, the architecture shown in FIG. 5 could achieve these three locations for any input channel without the use of any additional head-related transfer function filtering. Because of the assumption of symmetry in the left and right ear head-related transfer functions, each additional spatially filtered copy of an input signal that is added to the system adds two possible output locations for that particular signal.

An advantage of the present invention is that it can be accomplished without making any changes whatsoever to an existing centrally switched system communications system. Indeed, the only additional equipment/processing needed for the system is a front-end system that introduces a compensatory delay into each communication channel and produces (S−3)/2 digitally filtered copies (where S is the number of possible spatial locations) of each input, and a back-end cable that takes the output of two existing user stations and converts them to the left and right audio signals of a stereo headset. Internally to the switch, these spatially processed signals are treated exactly like normal communications signals. Thus, while this implementation requires a system with some excess switching capacity (i.e., the ability to add additional communications input signals and user stations), it potentially requires no hardware, software, or cabling changes in an existing legacy system. Especially in cases where a legacy system is no longer supported, is too expensive to modify, or is difficult to rewire, the non-invasive aspect of this method of implementation has tremendous advantages over the current state of the art.

Because this spatial implementation requires no changes in the existing switching system, any number of user stations can be upgraded to implement the 3D audio capability without interfering with the operation of any other aspects of the system. Similarly, the spatial filtering can be applied to any desired number of input channels without influencing the operation of any other output channel. Indeed, even those channels that receive no additional spatial filtering on the input side can receive the benefits of spatial separation for those users equipped with spatial output systems by presenting them either in the left ear only, right ear only, or both ears. Furthermore, those channels that are spatially processed will essentially be indistinguishable from the non-processed signals to users who inadvertently select to listen to them from a normal (monaural) listening station, because, to a first approximation, they will differ from the non-processed input signals only by a slight delay and a small amount of attenuation.

Figure 1:
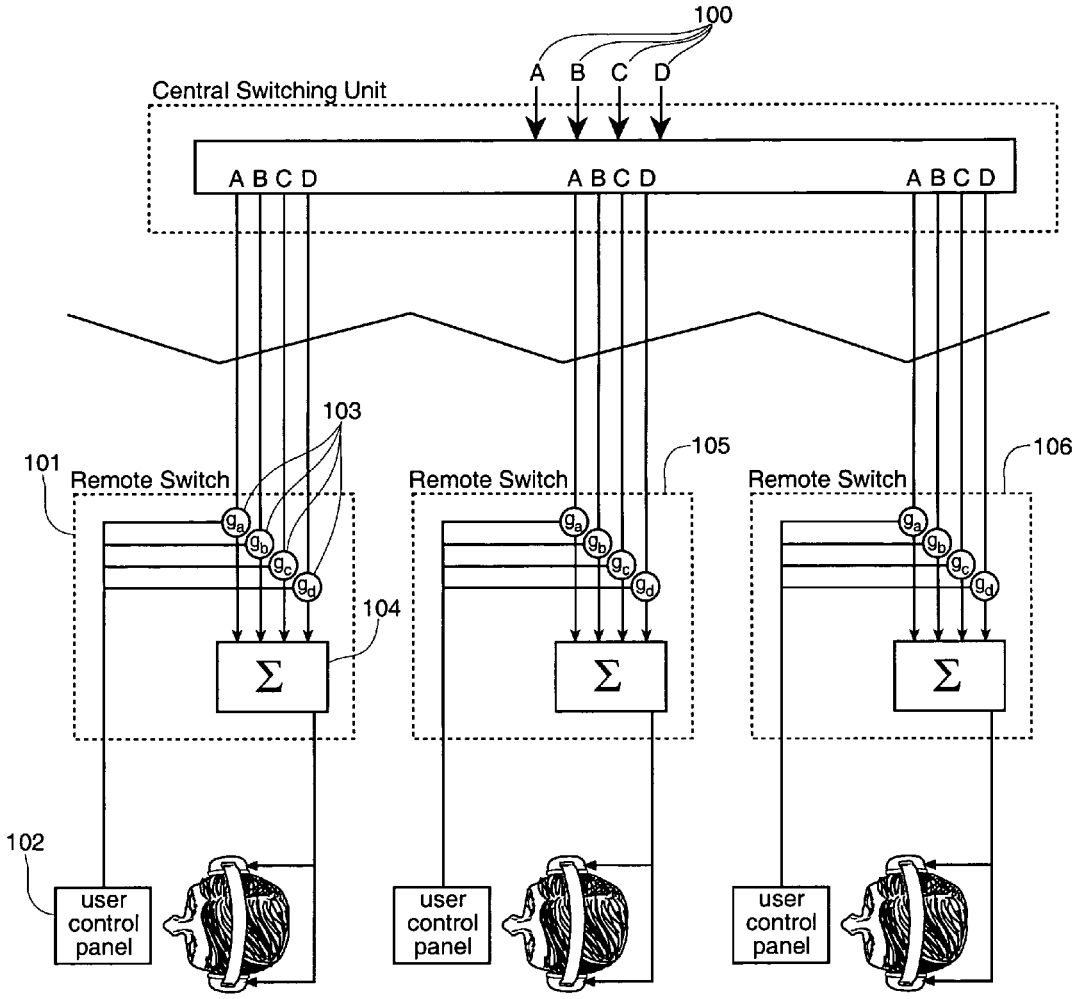
Fig. 1 PRIOR ART
FIG. 1 is a prior art multichannel communication system with distributed switching architecture.
Figure 2:
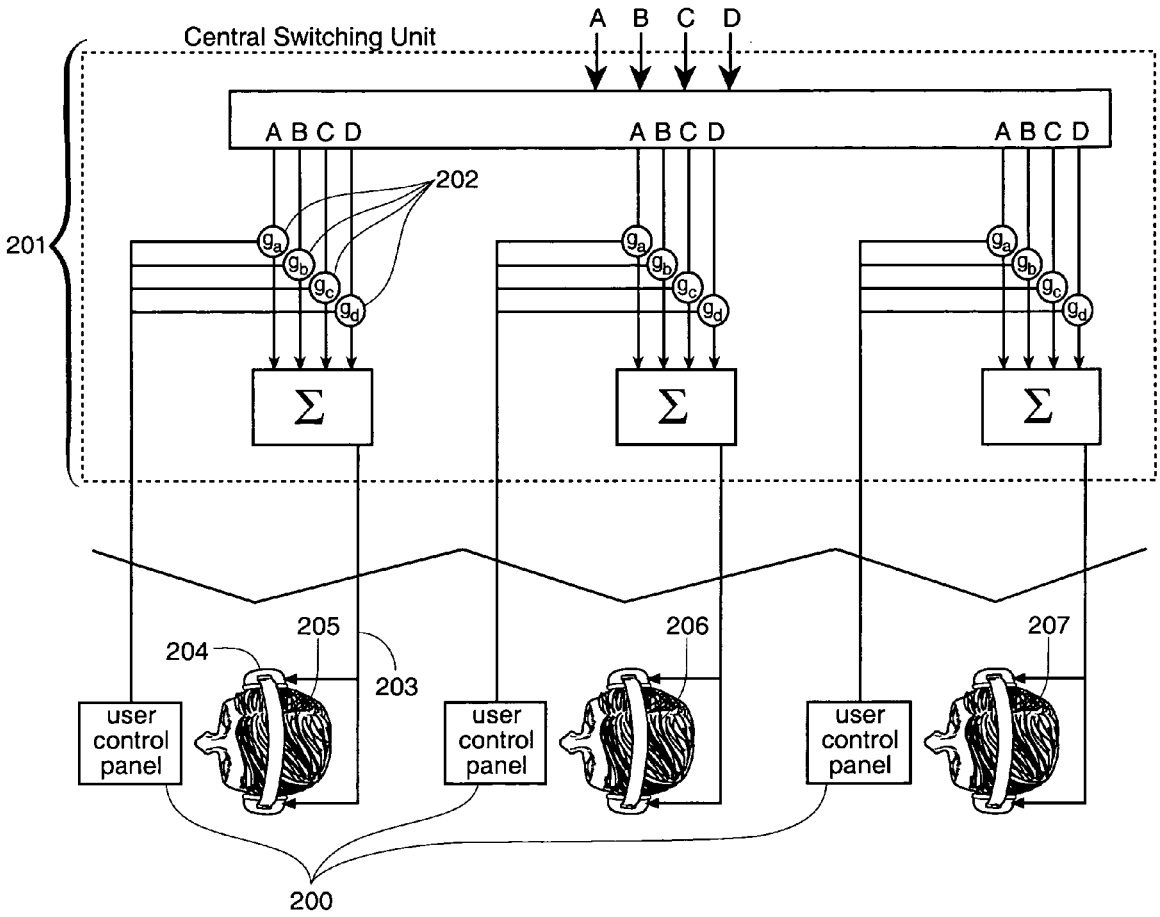
Fig. 2 PRIOR ART
FIG. 2 is a prior art multichannel communication system with central switching architecture.
Figure 3:
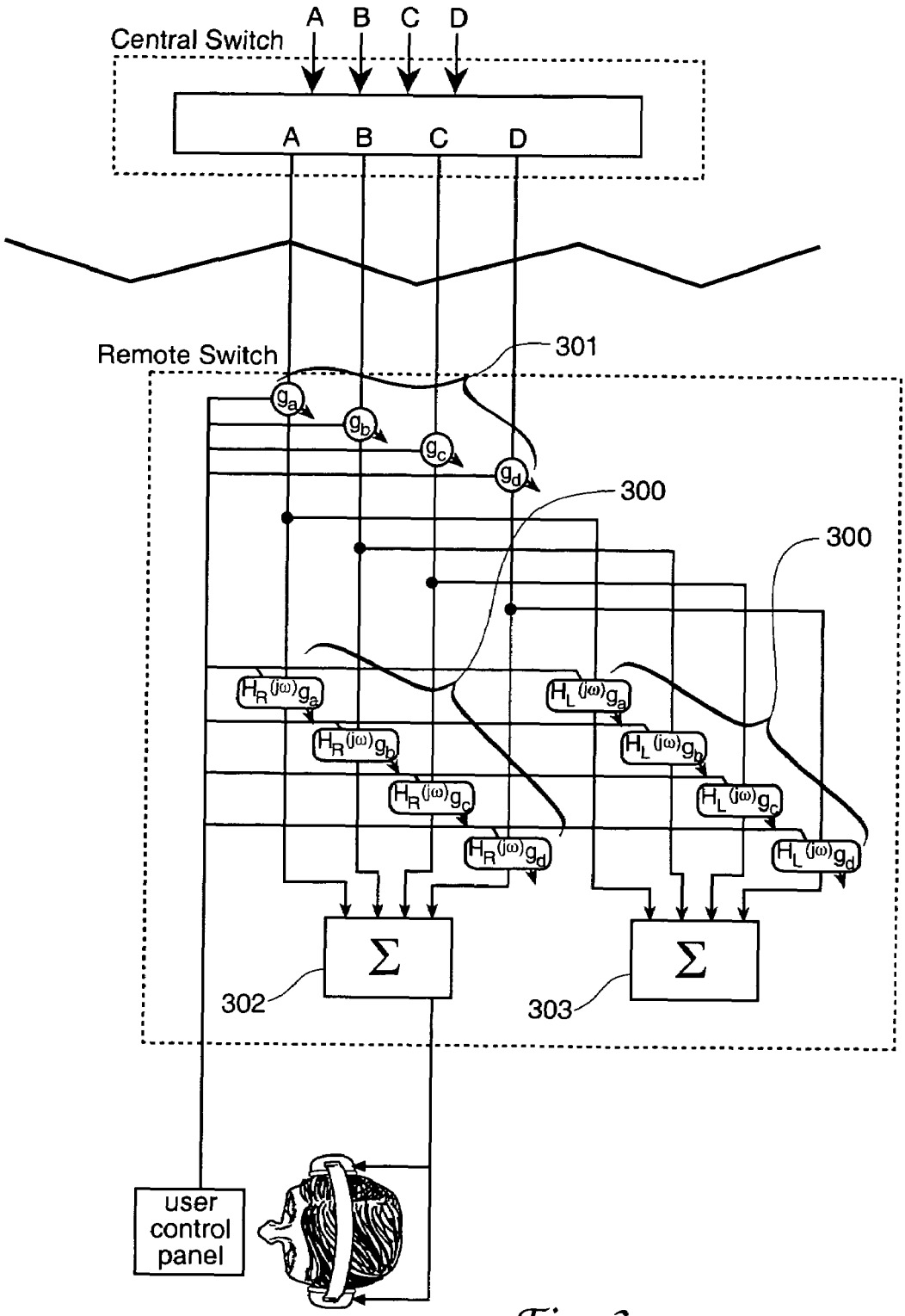
Fig. 3 PRIOR ART
FIG. 3 is a prior art spatialized audio implementation with distributed switching.
Figure 4:
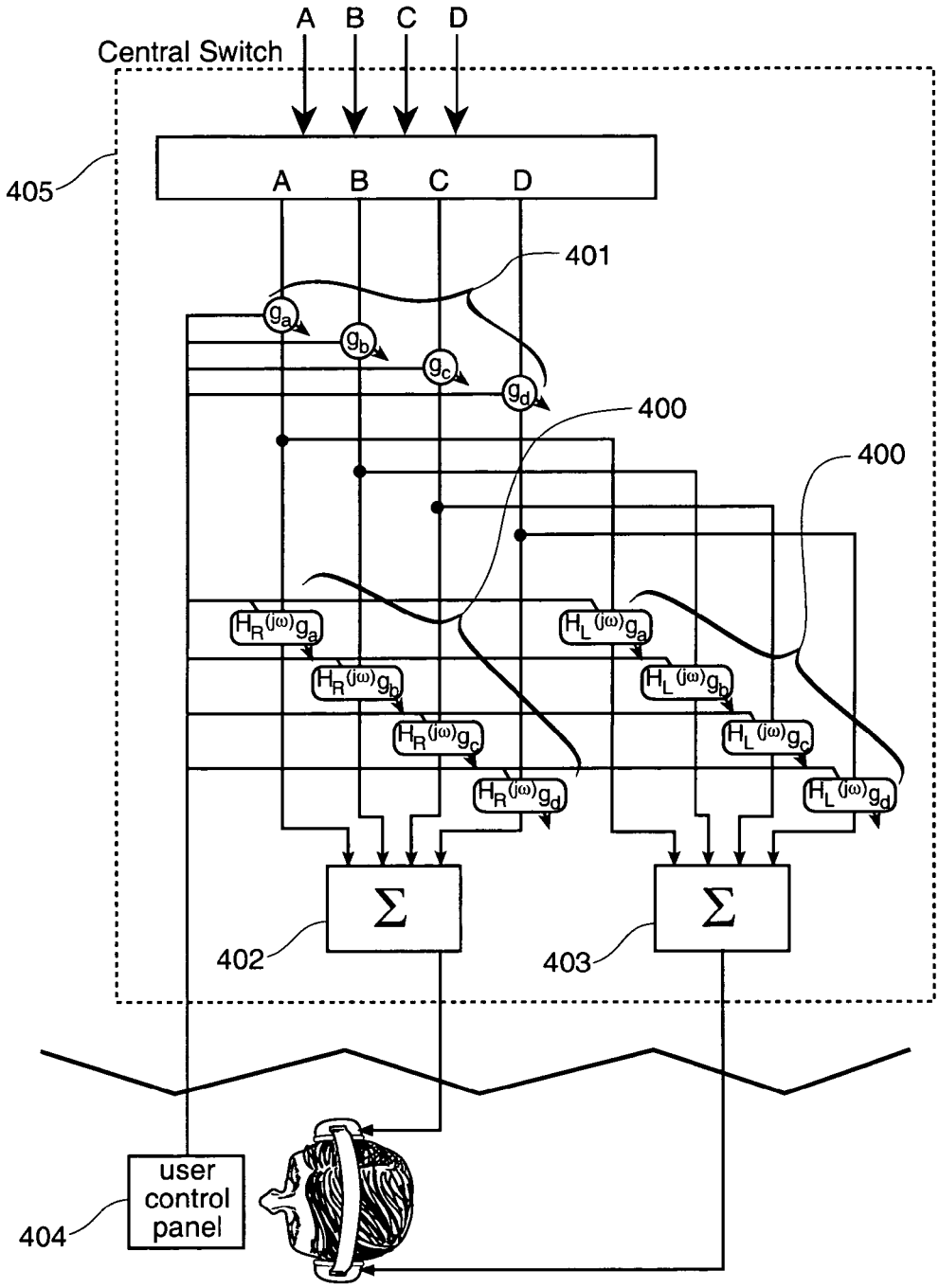
Fig. 4 PRIOR ART
FIG. 4 is a prior art spatialized audio implementation with central switching.

In the conventional implementation of 3D audio in a centrally switched communication system shown in FIG. 4, each of the M output signals presented to each listener required the implementation of two FIR filters (one for each ear) illustrated at 400 prior to being output to the listener. Thus, a system with N listeners and M output signals would require up to 2*M*N real-time FIR filters to spatialize the output speech signals. In contrast, the system of the present invention shown in FIG. 5 requires only M*(S−1)/2 concurrently running digital filters (where S is the number of desired possible spatial locations for each input channel), independent of the number of users of the system. Even assuming that each output channel should have up to 9 possible spatial locations, this implies that the current implementation would require no more digital processing power than the conventional implementation with only 2 users, and that it would require 10-times fewer concurrently-running digital filters than a conventional system with 20 users.

Of course, in applications with a large number of input channels, a carefully optimized conventional system could take advantage of the fact that not all users will be simultaneously listening to all possible input channels (and thus not all input channels will need to be spatially processed for each user). However, this optimization would come at the cost of considerable additional software complexity. Under the proposed implementation, the only control signal from the user station to the central switch is a vector of gain values indicating how each possible input signal should be scaled prior to being summed together and output to the listener's audio channel (where 0 gain values indicate a channel should be turned off). Under the conventional spatialized system, the user control panel would also have to send back an additional control signal to indicate which set of filters should be used to process each output channel, and an optimized system would have to dynamically determine whether or not a filter should be used for each channel. Thus, the conventional implementation would not only require more FIR filters than the proposed implementation, but those filters would also have to be switchable and dynamically allocatable. In contrast, the proposed implementation uses only fixed digital filters which are extremely easy to implement.

A preferred arrangement of the invention shown in FIG. 5 represents the most basic system that can be achieved with a minimum of changes to the existing architecture of a centrally switched communication system. The main drawback of this implementation is the user interface: in this implementation, the user must make two selections for each communications signal (one for each ear) and, furthermore, must also ensure that the relative gain levels of each communications signal are the same in both ears for all the active channels of the system.

Figure 7:
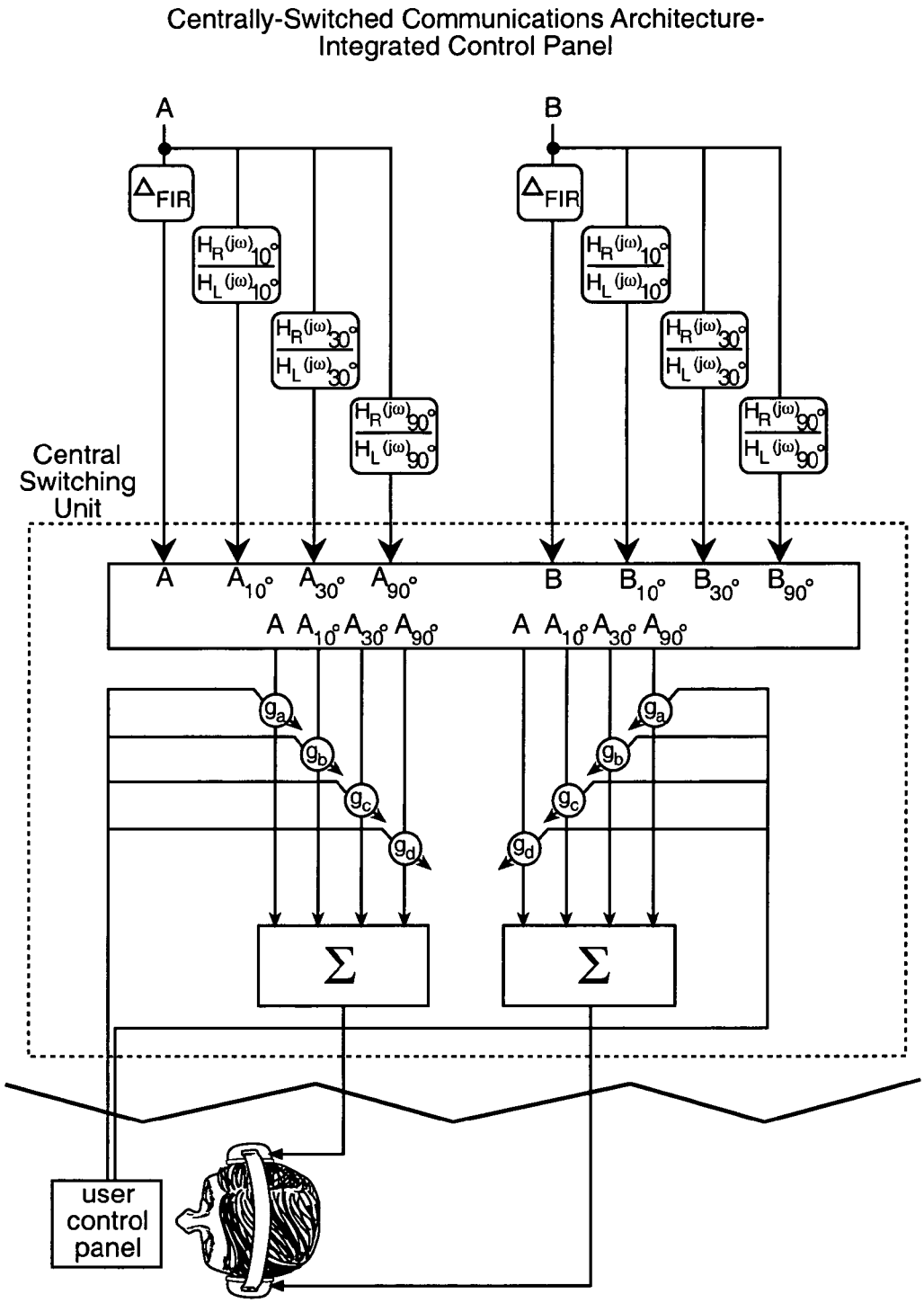
FIG. 7 is a centrally switched system with spatialized audio and an integrated user control panel according to the invention.

FIG. 7 shows another preferred arrangement of the invention that addresses the issue through the use of a redesigned integrated control panel that functionally interfaces with the central switch exactly like the two separate user stations shown in FIG. 5, but automates the selection of the left and right channels for each active talker location shown in FIG. 6 and also ensures that the changes in the relative gain levels of each talker are always applied to both ears simultaneously. Ideally, this interface might consist of a graphical user interface that allows the listener to physically drag and drop the desired communications channels into their desired locations through the use of a computer mouse or other similar device. However, a simpler but still just as effective solution is to use the same user interface as the existing control panel and simply present the user with additional communications channel selections that represent the different spatial locations associated with each radio channel. For example, a standard communications system might present a listener with the option of selecting any combination of three radio channels (Radio 1, Radio 2, and Radio 3), and adjusting the gain of each of those channels. An alternative implementation that included four filtered copies of radio channel 1 and no additional filtered input channels of any of the other radio might provide the user with the following choices:

Radio 1—0
Radio 1—+90C
Radio 1—−90C
Radio 1—+10
Radio 1—−10
Radio 1—+30
Radio 1—−30
Radio 1—+90
Radio 1—−90
Radio 2—0
Radio 2—+90 C
Radio 2—−90 C
Radio 3—0
Radio 3—+90C
Radio 3—−90C Selecting any one of these choices would automatically select the corresponding left and right ear channel combinations for each location shown in FIG. 6. The key advantage of this approach is that it can be achieved without changing the physical control panel station used by the operator.

Another alternative arrangement could be used to improve performance in situations where the audio signal that is returned to the user station is an analog speech-band signal and there are technical constraints that prevent the connection of a second wire between the location of the user and the location of the central switch. In that case, it would be possible to use frequency modulation to frequency shift the right ear audio signal to a higher frequency range than the left ear signal at the location of the switch, transmit both signals through a single analog wire to the location of the user station, and demodulate the two signals at the location of the user station. This would make it possible to implement spatial audio in a centrally switched system without running a second high-bandwidth audio signal to the location of each user.

While the apparatus and method herein described constitute a preferred embodiment of the invention, it is to be understood that the invention is not limited to this precise form of apparatus or method and that changes may be made therein without departing from the scope of the invention, which is defined in the appended claims.

What is claimed is:

1. A device for replicating spatial location of audio signals propagated from a distant sound source to a listener's left and right ears within a centrally switched multi-talker communication system comprising:

a plurality of input signals;

means for splitting each of said input signals into a plurality of duplicate signals;

a plurality of digital filters replicating a ratio of head-related transfer functions of the contralateral and ipsilateral ears for a particular spatial source location in a horizontal plane;

a central switching system for receiving output of said plurality of digital filters and processing as a plurality of different channels;

a left ear user control panel at the location of the user;

a right ear user control panel at the location of the user;

said right and left ear user control panels allowing selectibility from particular audio locations determined optimal for the presentation of speech in particular multitalker listening scenarios; and an audio display device for delivering output of said right and left ear user control panels to an operator whereby a user may appropriately select component audio signals presented to each ear and thereby place each input audio signal at a selected location.

2. The device of claim 1 for replicating spatial location of audio signals wherein said particular spatial source location is generated by presenting an unprocessed, digitally delayed copy of the original input signal in one ear and presenting a copy of an original input signal that has been filtered to replicate the ratio of the head-related transfer functions of contralateral and ipsilateral ears to other ears.

3. The device of claim 1 for replicating spatial location of audio signals wherein said plurality of digital filters is halved by assuming left-right symmetry in the head-related transfer functions of sound sources in the horizontal plane.

4. The device of claim 1 for replicating spatial location of audio signals wherein said plurality of digital filters further comprises M(S−3)/2 wherein S represents the number of possible spatial locations and M is the number of output signals presented to the listener.

5. The device of claim 1 for replicating spatial location of audio signals wherein said right and left ear user control panels allow selectibility from nine particular spatial locations including −10 degrees and −30 degrees and −90 degrees close and −90 degrees far and 90 degrees close and 90 degrees far and 0 and 10 degrees and 30 degrees.

6. The device of claim 1 for replicating spatial location of audio signals wherein the spatial location for −90 degrees close is simulated by presenting an unfiltered copy of the original input signal in the left ear and no corresponding signal in the right ear, and where the spatial location for +90 degrees close is simulated by presented an unfiltered copy of the original input signal in the right ear but no corresponding signal in the left ear.

7. The device of claim 1 for replicating spatial location of audio signals propagated from a distant sound source to a listener's left and right ears within a centrally switched multitalker communication system wherein said audio display device is a headset.

8. The device of claim 1 for replicating spatial location of audio signals propagated from a distant sound source to a listener's left and right ears within a centrally switched multitalker communication system wherein said plurality of digital filters further includes a plurality of digital filters for providing an offsetting delay compensating for delays associated with FIR filters.

9. The device of claim 1 for replicating spatial location of audio signals propagated from a distant sound source to a listener's left and right ears within a centrally switched multitalker communication system wherein said central switching system further comprises a plurality of different channels identified using a lateral angle of an angle of an associated head-related transfer function filter.

10. A device for replicating spatial location of audio signals propagated from a distant sound source to a listener's left and right ears within a centrally switched multi-talker communication system comprising:

a plurality of input signals;

means for splitting each of said input signals into a plurality of duplicate signals;

a plurality of digital filters replicating a ratio of head-related transfer functions of the contralateral and ipsilateral ears for a particular spatial source location in a horizontal plane;

a central switching system for receiving output of said plurality of digital filters; and an integrated user control panel that functionally interfaces with said central switching system like two separate user stations automating selection of the left and right ear;

said integrated user control panel allowing selectibility from particular audio locations optimal for the presentation of speech in multitalker listening scenarios.

11. The device for replicating spatial location of audio signals propagated from a distant sound source of claim 10 for spatial location listening selectability wherein said integrated user control panel further comprises means for ensuring that the changes in the relative gain levels of each talker are always applied to both ears simultaneously.

12. The device for replicating spatial location of audio signals propagated from a distant sound source of claim 10 for spatial location listening selectability wherein said integrated user control panel further comprises a graphical user interface that allows the listener to physically drag and drop the desired communications channels into their desired locations through the use of a computer mouse.

13. The device for replicating spatial location of audio signals propagated from a distant sound source of claim 10 for spatial location listening selectability wherein said integrated user control panel further comprises a graphical user interface comprising the existing control panel and additional communications channel selections that represent the different spatial locations associated with each radio channel.

14. A method for replicating spatial location of audio signals propagated from a distant sound source to a listener's left and right ears within a centrally switched multi-talker communication system comprising the steps of:

providing a plurality of input signals;

splitting each of said input signals into a plurality of duplicate signals;

determining interaural differences for a plurality of digital filters replicating a ratio of head-related transfer functions of contralateral and ipsilateral ears for a particular spatial source location in a horizontal plane;

receiving output of said plurality of digital filters into a central switching system and processing as a plurality of different channels;

providing a left ear user control panel at the location of the user;

providing a right ear user control panel at the location of the user;

selecting particular audio locations determined optimal for the presentation of speech in particular multitalker listening scenarios using right and left ear user control panels; and delivering output of said right and left ear user control panels to an operator using an audio display device whereby a user may appropriately select component audio signals presented to each ear and thereby place each input audio signal at a selected location.

15. The method of claim 14 for replicating spatial location of audio signals propagated from a distant sound source to a listener's left and right ears further comprising the step of generating said particular source location by presenting an unprocessed, digitally delayed copy of an original input signal in one ear and presenting a copy of an original input signal that has been filtered to replicate the ratio of the head-related transfer functions of contralateral and ipsilateral ears to other ears.

16. The method of claim 14 for replicating spatial location of audio signals propagated from a distant sound source to a listener's left and right ears within a centrally-switched multi-talker communication system wherein said determining step further comprises determining interaural differences for a plurality of lateral positions in space using M(S−3)/2 digital filters wherein S represents the number of possible spatial locations and M is the number of output signals presented to the listener.

17. The method of claim 14 for replicating spatial location of audio signals propagated from a distant sound source to a listener's left and right ears within a centrally-switched multi-talker communication system wherein said selecting step further comprises the step of selecting particular audio locations from nine particular spatial locations including −10 degrees and −30 degrees and −90 degrees close and −90 degrees far and 90 degrees close and 90 degrees far and 0 and 10 degrees and 30 degrees.

18. The method of claim 14 for replicating spatial location of audio signals propagated from a distant sound source to a listener's left and right ears within a centrally switched multi-talker communication system wherein said delivering step further comprises delivering output of said right and left ear user control panels to an operator using a audio headset.

19. The method of claim 14 for replicating spatial location of audio signals propagated from a distant sound source to a listener's left and right ears within a centrally switched multi-talker communication system wherein said determining step further comprises determining interaural differences for a plurality of digital filters assuming left-right symmetry in the head-related transfer functions of sound sources in the horizontal plane thereby halving the number of digital filters.

20. The method of claim 14 for replicating spatial location of audio signals propagated from a distant sound source to a listener's left and right ears within a centrally switched multi-talker communication system wherein said determining step further comprises determining interaural differences for a plurality of lateral positions in space and for providing an offsetting delay compensating for delays associated with FIR filters using a plurality of digital filters.

* * * * *